US012140143B1

(12) United States Patent
Liu et al.

(10) Patent No.: US 12,140,143 B1
(45) Date of Patent: Nov. 12, 2024

(54) FLUID MACHINE AND OPERATING METHOD THEREOF

(71) Applicant: FU SHENG INDUSTRIAL CO., LTD., Taipei (TW)

(72) Inventors: Yao-Chung Liu, Taipei (TW); Wei-Hsu Lin, Taipei (TW)

(73) Assignee: FU SHENG INDUSTRIAL CO., LTD., Taipei (TW)

( * ) Notice: Subject to any disclaimer, the term of this patent is extended or adjusted under 35 U.S.C. 154(b) by 0 days.

(21) Appl. No.: 18/656,887

(22) Filed: May 7, 2024

(30) Foreign Application Priority Data

Jun. 17, 2023 (TW) ..... 112122808

(51) Int. Cl.
*F04C 18/16* (2006.01)
*F04C 23/00* (2006.01)
*F04C 23/02* (2006.01)

(52) U.S. Cl.
CPC ..... *F04C 18/16* (2013.01); *F04C 23/001* (2013.01); *F04C 23/02* (2013.01)

(58) Field of Classification Search
CPC ..... F04C 18/16; F04C 18/084; F04C 23/001; F04C 23/02; F04C 29/00; F04C 29/12; F04C 29/028; F04C 28/24; F04C 28/12
See application file for complete search history.

(56) References Cited

U.S. PATENT DOCUMENTS 10,808,699 B2 * 10/2020 Joseph ..... F04C 18/16
10,876,531 B2 * 12/2020 Novak ..... F25B 31/004
2007/0003421 A1 * 1/2007 Kato ..... F04C 18/16 417/423.1
2017/0030356 A1 * 2/2017 Yonemoto ..... F04C 28/12
2020/0080559 A1 * 3/2020 Liu ..... F04C 23/001

FOREIGN PATENT DOCUMENTS

JP 2012102967 A 5/2012
TW 202010942 A 3/2020

OTHER PUBLICATIONS

Office Action dated Feb. 20, 2024 of the corresponding Taiwan patent application No. 112122808.

* cited by examiner

*Primary Examiner* — Dapinder Singh
(74) *Attorney, Agent, or Firm* — Chun-Ming Shih; HDLS IPR SERVICES

(57) ABSTRACT

A fluid machine and its operating method are provided. The fluid machine (10) includes a main body (1), a screw set (2), a capacity adjustment mechanism (3), an intermediate pressure sensor (5), and a controller (6). The main body (1) includes a low-pressure chamber (11), an intermediate-pressure chamber (12), and a high-pressure chamber (13). The screw set (2) includes a pair of first screws (21) in the low-pressure chamber (11) and a pair of second screws (22) in the high-pressure chamber (13). The capacity adjustment mechanism (4) includes a first slide valve (41) disposed corresponding to the first screws (21) and a second slide valve (42) disposed corresponding to the second screws (22). The intermediate pressure sensor (5) is placed in the intermediate-pressure chamber (12) for obtaining its interior pressure. The controller (6) drives movement of the first slide valve (41) and the second slide valve (42).

15 Claims, 19 Drawing Sheets

FLUID MACHINE AND OPERATING METHOD THEREOF

BACKGROUND OF THE INVENTION

Technical Field

The present disclosure relates to a fluid machine such as a compressor or expander and, more particularly, to a fluid machine and an operating method thereof.

DESCRIPTION OF RELATED ART

Existing common two-stage helical machines internally have a sequentially connected low-pressure chamber, an intermediate-pressure chamber, and a high-pressure chamber. The low-pressure chamber houses a first-stage rotor, the high-pressure chamber houses a second-stage rotor, and the intermediate-pressure chamber accommodates a motor and a rotary shaft that connects the first-stage rotor and the second-stage rotor. Fluids (such as refrigerants, coolants, etc.) are compressed by the first-stage and second-stage rotors in succession, causing the fluid pressure in the low-pressure chamber, intermediate-pressure chamber, and high-pressure chamber to be at low, intermediate, and high pressures, respectively.

However, the intermediate pressure in the intermediate-pressure chamber of the conventional two-stage helical machine cannot be adjusted and can only passively conform to changes in system pressure, preventing the two-stage helical machine from achieving optimal efficiency. Moreover, when the suction pressure is too high, it may cause the pressure (intermediate pressure) in the intermediate-pressure chamber to be too high, which may prevent the injection of a lubricating fluid into the intermediate-pressure and high-pressure chambers. This results in insufficient oil supply pressure difference for the second-stage rotor, thereby reducing the efficiency of the two-stage helical machine.

In view of this, the inventor has targeted the aforementioned existing technologies and devoted himself to research and the application of theory to strive to solve the above problems, which has become the goal of the inventor's development.

SUMMARY OF THE INVENTION

The present disclosure provides a fluid machine and an operating method thereof. Based on a rotational speed of co-axially rotating first and second screws and interior pressure values of an intermediate-pressure chamber, a controller adjusts relative positions of a first slide valve to the first screws and a second slide valve to the second screws. This adjustment modifies the interior pressure of the intermediate-pressure chamber to prevent excessive pressure, ensuring that a lubricating fluid is steadily injected into the intermediate chamber and a high-pressure chamber. The lubricating fluid continuously lubricates the second screws, enhancing the operational efficiency of the fluid machine.

In embodiments of the present disclosure, a fluid machine is provided, including: a main body internally divided into a low-pressure chamber, an intermediate-pressure chamber, and a high-pressure chamber, sequentially interconnected to each other; a screw set, including a pair of first screws accommodated in the low-pressure chamber and engaged with each other, and a pair of second screws accommodated in the high-pressure chamber and engaged with each other, wherein a first contact line is defined between the pair of first screws, and a second contact line is defined between the pair of second screws; a drive module disposed in the intermediate-pressure chamber, wherein the drive module is connected to and drives one of the first screws and one of the second screws to rotate coaxially; a capacity adjustment mechanism, including a first slide valve movably disposed corresponding to the first contact line and a second slide valve movably disposed corresponding to the second contact line;

an intermediate pressure sensor disposed in the intermediate-pressure chamber, wherein the intermediate pressure sensor obtains an interior pressure of the intermediate-pressure chamber; and a controller connected to and driving movement of the first slide valve and the second slide valve, wherein the controller adjusts relative positions of the first slide valve to the pair of first screws and the second slide valve to the pair of second screws, based on a rotational speed at which one of the first screws and one of the second screws co-axially rotate, as well as values of the interior pressure; wherein the low-pressure chamber is provided with an intake port, and the high-pressure chamber is provided with an exhaust port, the pair of first screws is provided with a first suction end and a first discharge end at two ends, the pair of second screws is provided with a second suction end and a second discharge end at two ends, one end of the first slide valve includes a first low-pressure end arranged corresponding to the first suction end, another end of the first slide valve includes a first radial notch arranged corresponding to the first contact line, one end of the second slide valve includes a second low-pressure end arranged corresponding to the second suction end, and another end of the second slide valve includes a second radial notch arranged corresponding to the second contact line.

According to one embodiment of the present disclosure, an operating method of a fluid machine is provided, including following steps: step A, providing the fluid machine of claim 2, positioning the first slide valve between the intermediate-pressure chamber and the first discharge end, and positioning the second slide valve between the exhaust port and the second discharge end, wherein the drive module drives one of the first screws and one of the second screws to rotate at a preset rotational speed with a fixed frequency; step B, the controller controlling the second slide valve to move from between the exhaust port and the second discharge end towards the second suction end; and step C, the controller controlling the first slide valve to move from between the intermediate-pressure chamber and the first discharge end towards the first suction end, until the intermediate pressure sensor detects that the interior pressure of the intermediate-pressure chamber is equal to a preset intermediate pressure.

According to one embodiment of the present disclosure, an operating method of a fluid machine is provided, including following steps: step F, providing the fluid machine of claim 2, positioning the first slide valve between the intermediate-pressure chamber and the first discharge end, and positioning the second slide valve between the exhaust port and the second discharge end, wherein the drive module drives one of the first screws and one of the second screws to rotate at a preset rotational speed with a fixed frequency; step G, the controller controlling the first slide valve to move from the first discharge end towards the first suction end until the first slide valve covers the first suction end, and the second slide valve to move from the second discharge end towards the second suction end such that one end of the second slide valve is positioned between the second suction end and the second discharge end, and another end of the second slide valve is positioned between the exhaust port and the second discharge end; and step H, the controller first controlling the first radial notch to be positioned at a designated position between the first suction end and the first discharge end, then controlling the second slide valve to move towards either the second suction end or the second discharge end, until the intermediate pressure sensor detects that the interior pressure of the intermediate-pressure chamber is equal to the preset intermediate pressure.

According to one embodiment of the present disclosure, an operating method of a fluid machine is provided, including following steps: step K, providing the fluid machine of claim 2, positioning the first radial notch between the first suction end and a midpoint of the pair of first screws, the drive module driving one of the first screws and one of the second screws to accelerate to rotate at a low rotational speed; step L, the controller controlling the second slide valve to move from the second discharge end towards the second suction end, such that one end of the second slide valve is positioned between the second suction end and the second discharge end, and another end of the second slide valve is positioned between the exhaust port and the second discharge end, the drive module then continuing to accelerate one of the first screws and one of the second screws to a preset rotational speed for constant-speed rotation; and step M, the controller first positioning the first radial notch at a designated position between the first suction end and the first discharge end, then controlling the second slide valve to move towards either the second suction end or the second discharge end, until the intermediate pressure sensor detects that the interior pressure of the intermediate-pressure chamber is equal to a preset intermediate pressure.

In this disclosure, the controller adjusts the positions of the first slide valve and the second slide valve relative to the pair of first screws and the pair of second screws, respectively, based on the rotational speeds of the first and second screws and the interior pressure values of the intermediate-pressure chamber. This adjustment regulates the interior pressure of the intermediate-pressure chamber to maintain the interior pressure at a preset intermediate pressure, ensuring that the lubricating fluid is steadily injected into the intermediate-pressure chamber and the high-pressure chamber. Once the lubricating fluid enters the intermediate-pressure chamber and the high-pressure chamber, the lubricating fluid continues to lubricate the second screw with the fluid flow, achieving good operational efficiency for the fluid machine of this disclosure.

DETAILED DESCRIPTION

Figure 1:
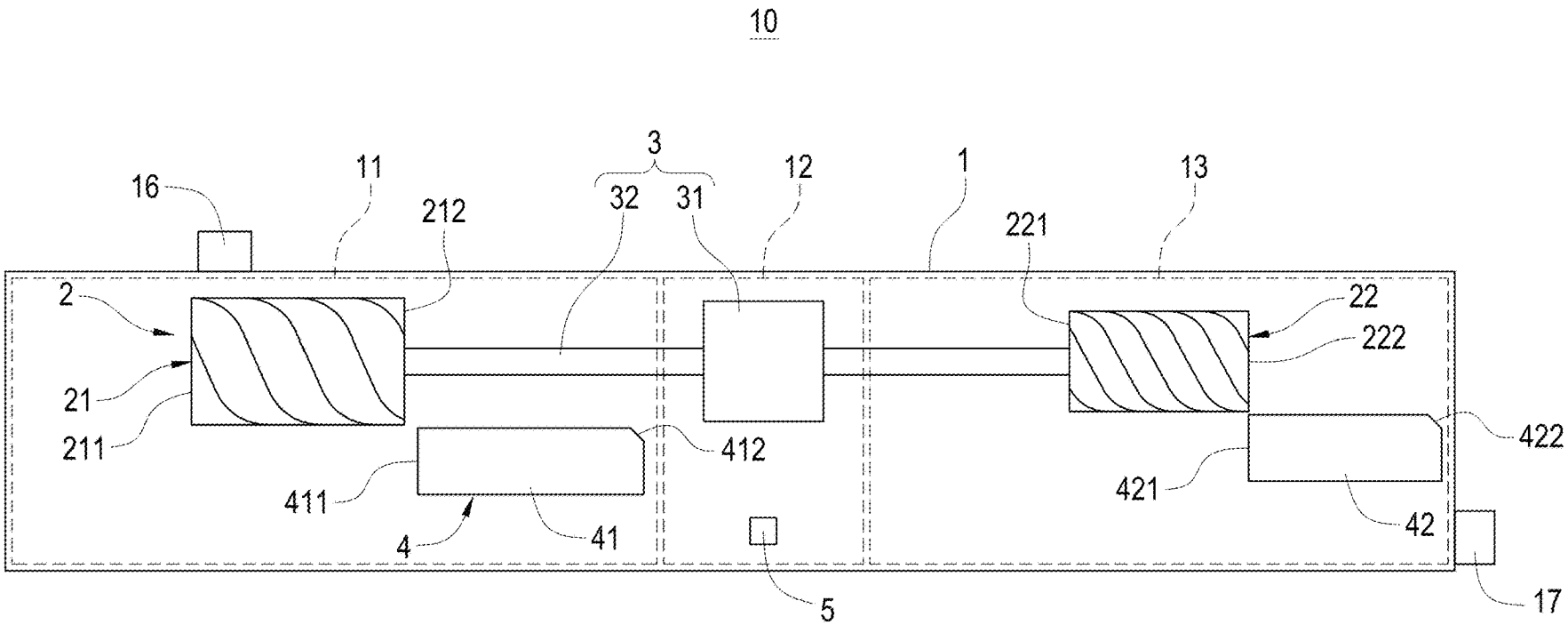
FIG. 1 is a side schematic view of a fluid machine of the present disclosure.

The detailed description and technical content related to the present disclosure are explained in conjunction with the drawings below. However, the attached drawings are only for illustrative purposes and are not meant to limit the present disclosure.

Please refer to FIGS. 1 through 19. The present disclosure provides a fluid machine and an operating method. The fluid machine 10 mainly includes a main body 1, a screw set 2, a drive module 3, a capacity adjustment mechanism 4, an intermediate pressure sensor 5, and a controller 6.

Figure 2:
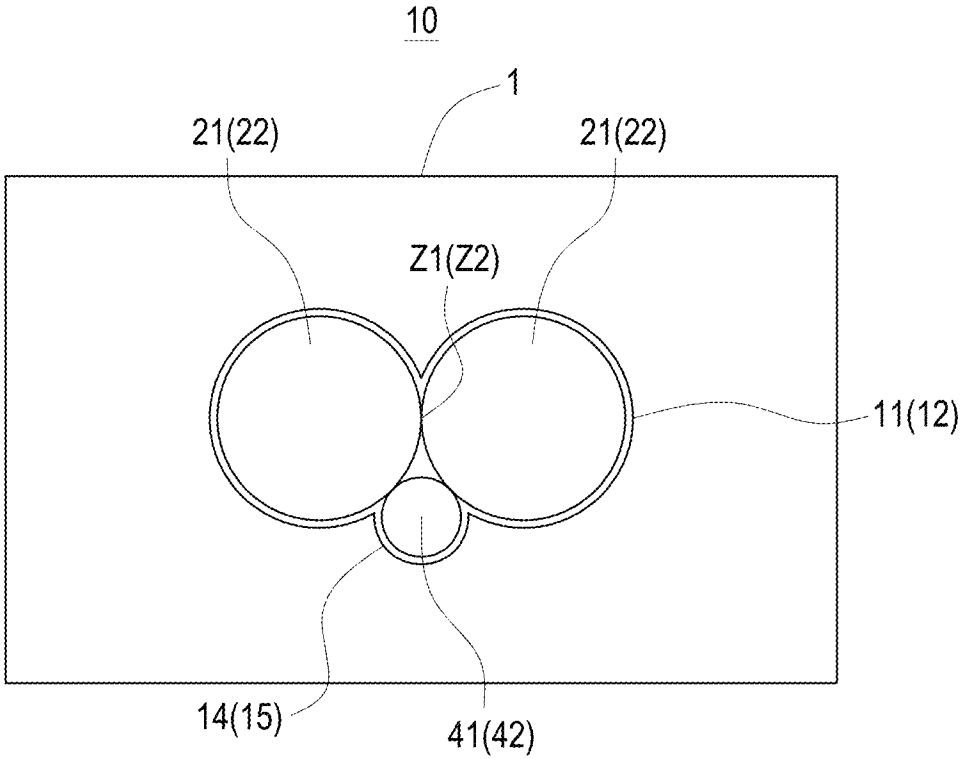
FIG. 2 is a front schematic view of the fluid machine of the present disclosure.

As shown in FIGS. 1 and 2, an interior of the main body 1 is divided into a low-pressure chamber 11, an intermediate-pressure chamber 12, and a high-pressure chamber 13, which are sequentially interconnected. The main body 1 includes a first auxiliary chamber 14 arranged on one side of the low-pressure chamber 11 and communicating with low-pressure chamber 11, and a second auxiliary chamber 15 arranged on one side of the high-pressure chamber 13 and communicating with the high-pressure chamber 13. Moreover, the low-pressure chamber 11 has an intake port 16, and the high-pressure chamber 13 has an exhaust port 17. The intermediate-pressure chamber 12 and the high-pressure chamber 13 communicate with an oil reservoir (not illustrated), which is used to inject a lubricating fluid into the intermediate-pressure chamber 12 and the high-pressure chamber 13.

As shown in FIGS. 1 and 2, the screw set 2 includes a pair of first screws 21 housed in the low-pressure chamber 11 and meshing with each other, and a pair of second screws 22 housed in the high-pressure chamber 13 and meshing with each other. A first contact line Z1 is defined between meshing male and female helical tooth surfaces of the pair of first screws 21, and a second contact line Z2 is defined between meshing male and female helical tooth surfaces of the pair of second screws 22.

Additionally, the pair of first screws 21 is provided with a first suction end 211 and a first discharge end 212 at two ends, and the pair of second screws 22 is provided with a second suction end 221 and a second discharge end 222 at two ends.

A fluid (such as refrigerant, coolant, etc.) starts from the intake port 16 and sequentially passes through the low-pressure chamber 11, the first suction ends 211 of the first screws 21, the first discharge ends 212 of the first screws 21, the intermediate-pressure chamber 12, the high-pressure chamber 13, the second suction ends 221 of the second screws 22, and the second discharge ends 222 of the second screws 22, and is finally expelled from the exhaust port 17. Because the fluid is successively compressed by the first screws 21 and the second screws 22, the fluid pressure in the low-pressure chamber 11, the intermediate-pressure chamber 12, and the high-pressure chamber 13 is respectively at low, intermediate, and high pressures.

Moreover, the fluid machine 10 of this disclosure further includes an evaporator (not illustrated) and a temperature sensor (not illustrated) installed on the evaporator. The fluid flows through the low-pressure chamber 11, the intermediate-pressure chamber 12, the high-pressure chamber 13, and the evaporator (not illustrated). The temperature sensor or a pressure sensor (not illustrated) is used to detect and obtain the temperature and pressure of the evaporator. The aforementioned temperature could be a target temperature set for the evaporator or an actual temperature of the environment that the evaporator has created. The controller may use the measured temperature and pressure to calculate a saturation temperature of the refrigerant, thereby controlling the capacity adjustment mechanism 4.

As shown in FIG. 1, the drive module 3 is accommodated within the intermediate-pressure chamber 12 and includes a motor 31 and one or two drive shafts 32 that connect to the motor 31, the pair of first screws 21, and the pair of second screws 22. The motor 31 drives one of the first screws 21 and one of the second screws 22 to rotate coaxially via the drive shaft 32.

In this embodiment, there is one drive shaft 32 that co-axially drives both one of the first screws 21 and one of the second screws 22. However, this configuration is not limiting; there may be two drive shafts, with rotational axes of both the drive shafts 32 aligned on the same line. In such a case, one drive shaft 32 connects to the motor 31 and one of the first screws 21, and the other drive shaft 32 connects to the motor 31 and one of the second screws 22. This setup independently drives both one of the first screws 21 and one of the second screws 22 to rotate coaxially.

As shown in FIGS. 1 and 2, the capacity adjustment mechanism 4 includes a first slide valve 41, which is movably disposed corresponding to the first contact line Z1, and a second slide valve 42, which is movably set corresponding to the second contact line Z2. The first slide valve 41 is accommodated and slides within the first auxiliary chamber 14, while the second slide valve 42 is accommodated and slides within the second auxiliary chamber 15.

The detailed explanation is as follows. One end of the first slide valve 41 is provided with a first low-pressure end 411 arranged corresponding to the first suction end 211, and the other end of the first slide valve 41 is provided with a first radial notch 412 arranged corresponding to the first contact line Z1. The more the first slide valve 41 covers a surface of the pair of first screws 21, the larger a working area of the pair of first screws 21, and the higher a refrigerant suction pressure. The first radial notch 412 may be arranged corresponding to any groove location within spiral grooves of the pair of first screws 21, thereby enabling control over when the low-pressure chamber 11 begins to exhaust and an exhaust pressure at which this exhaust happens. The closer a position of the first radial notch 412 is to the first discharge end 212, the greater the exhaust pressure.

Additionally, one end of the second slide valve 42 is provided with a second low-pressure end 421 arranged corresponding to the second suction end 221, and the other end of the second slide valve 42 is provided with a second radial notch 422 arranged corresponding to the second contact line Z2. The more the second slide valve 42 covers an area of the second screws 22, the larger a working area for the second screws 22, and the higher the refrigerant suction pressure. The second radial notch 422 may be positioned corresponding to any groove location within spiral grooves of the pair of the second screws 22, thereby controlling when the high-pressure chamber 13 begins to exhaust and an exhaust pressure at which this exhaust happens. The closer a position of the second radial notch 422 is to the second discharge end 222, the greater the exhaust pressure.

As shown in FIGS. 1 and 2, the intermediate pressure sensor 5 is accommodated within the intermediate-pressure chamber 12. The intermediate pressure sensor 5 is used to sense and obtain an internal pressure of the intermediate-pressure chamber 12, that is, to measure an interior pressure of the intermediate-pressure chamber 12 and generate an intermediate-pressure chamber pressure signal.

Moreover, a pressure sensor (not illustrated) is also installed inside the intake port 16, which is used to sense and obtain a pressure at the intake port 16.

Figure 3:
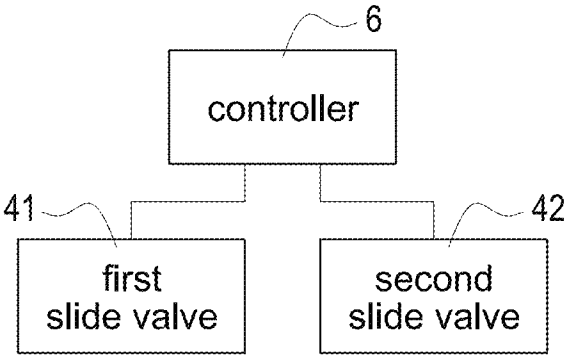
FIG. 3 is a block diagram of a controller, a first slide valve, and a second slide valve of the present disclosure.

As shown in FIG. 3, the controller 6 is connected to and drives the movement of the first slide valve 41 and the second slide valve 42. Based on a rotational speed at which one of the first screws 21 and one of the second screws 22 co-axially rotate, as well as the values of the interior pressure, the controller 6 thus moves the first slide valve 41 relative to the pair of first screws 21, and moves the second slide valve 42 relative to the pair of second screws 22. That is, upon receiving the pressure signals from the intermediate-pressure chamber and the intake port 16, the controller 6 judges and calculates to adjust the relative positions of the first slide valve 41 and the second slide valve 42.

Figure 4:
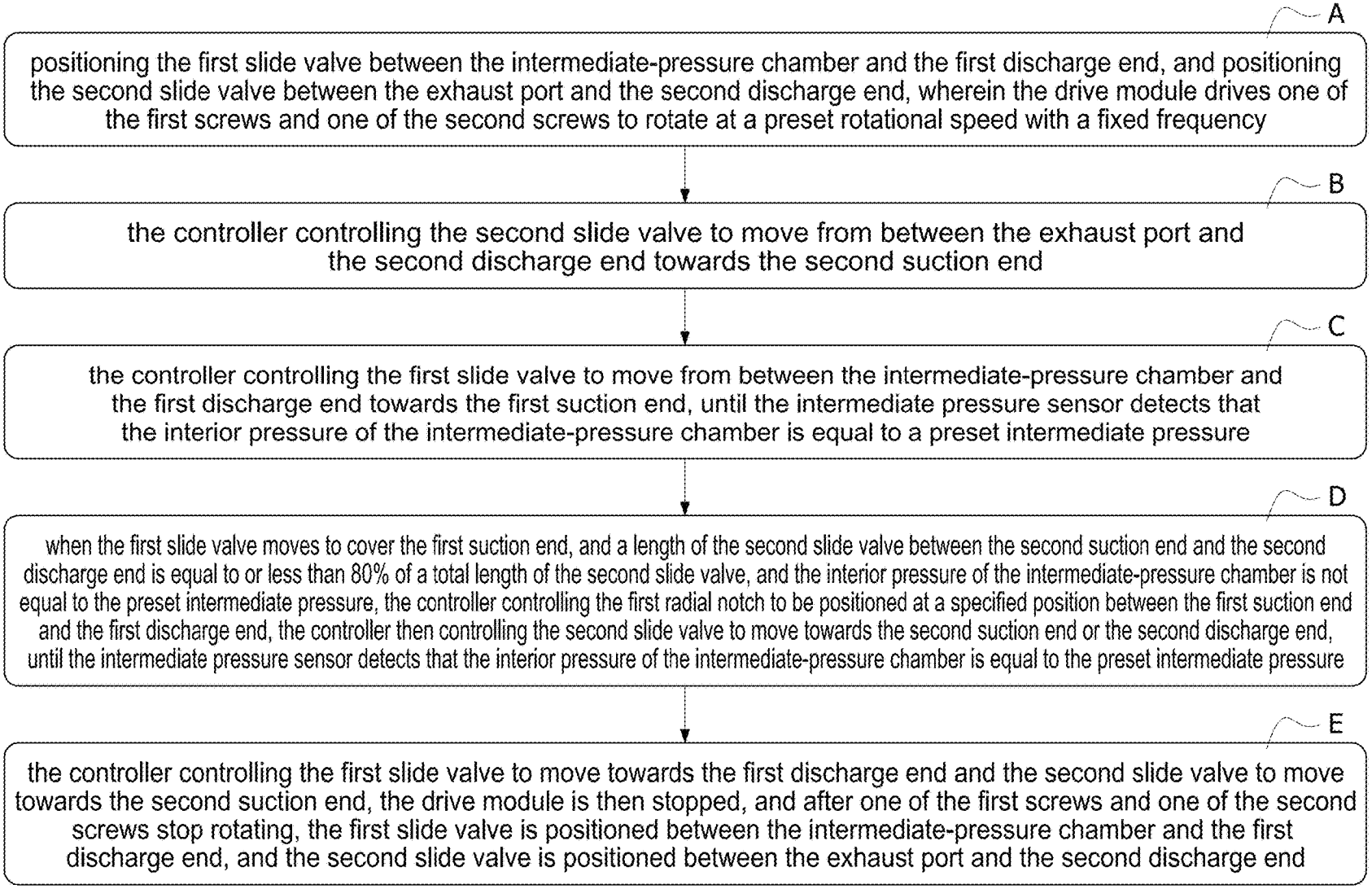
FIG. 4 is a flowchart of a first step in an operating method of the fluid machine of the present disclosure.

FIG. 4 illustrates a first step in an operating method of the fluid machine 10 of the present disclosure, further explained as follows. First, as shown in step A of FIG. 4 and in FIG. 5, a fluid machine 10 as previously described is provided. The first slide valve 41 is disposed between the intermediate-pressure chamber 12 and the first discharge end 212, and the second slide valve 42 is disposed between the exhaust port 17 and the second discharge end 222. The drive module 3 drives one of the first screws 21 and one of the second screws 22 to rotate at a constant preset rotational speed, which is between 2950 to 3600 rpm, meaning a rotational frequency of the pair of first screws 21 and the pair of second screws 22 is fixed. When the first screw 21 and the second screw 22 begin to rotate, the lubricating fluid starts to be injected into the intermediate-pressure chamber 12 and the high-pressure chamber 13.

Figure 6:
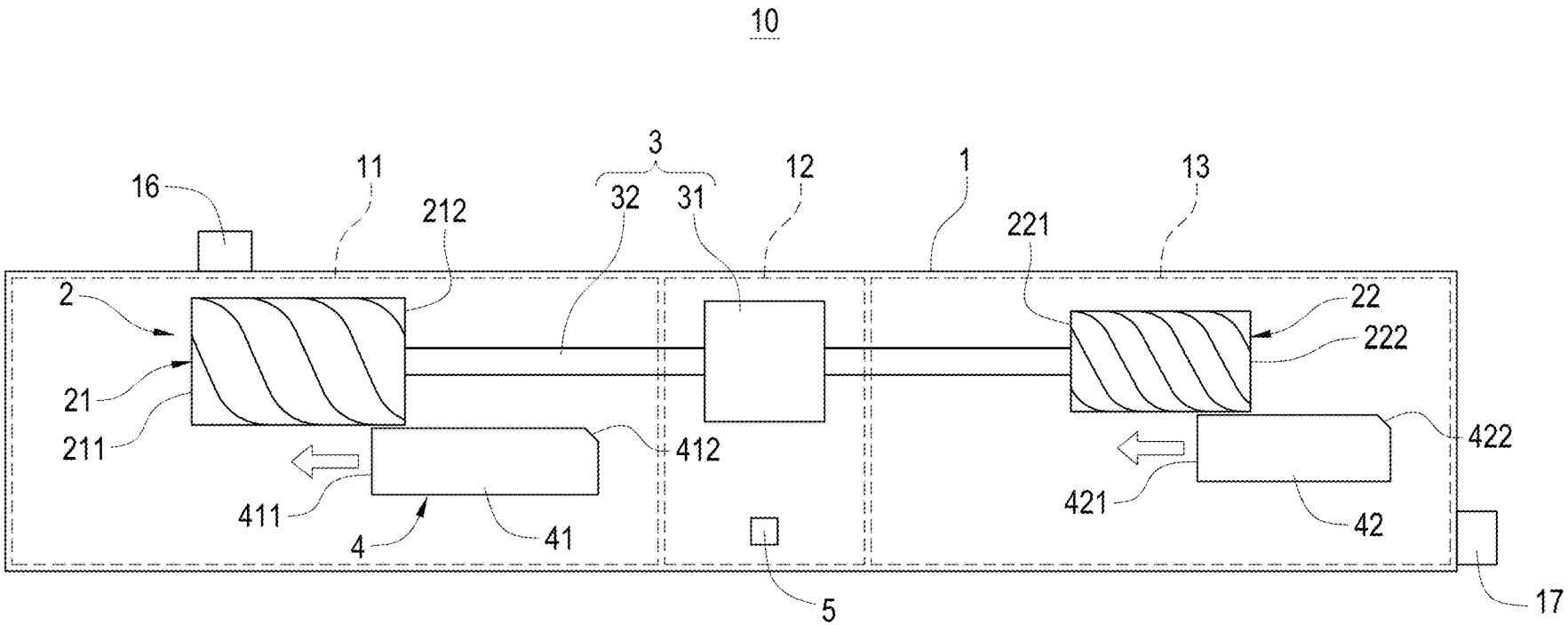
FIG. 6 is a schematic view of a second operating state of the fluid machine of the present disclosure.

Second, as shown in step B of FIG. 4 and in FIG. 6, the controller 6 controls the second slide valve 42 to move from between the exhaust port 17 and the second discharge end 222 towards the second suction end 221, thereby increasing a suction volume of the pair of second screws 22.

Third, as shown in step C of FIG. 4 and in FIG. 6, the controller 6 controls the first slide valve 41 to move from between the intermediate-pressure chamber 12 and the first discharge end 212 towards the first suction end 211, thereby increasing a suction volume of the pair of first screws 21, until the intermediate pressure sensor 5 detects that the interior pressure of the intermediate-pressure chamber 12 is equal to a preset intermediate pressure. The position of the first slide valve 41 is determined by the controller 6 through calculations using the signals of the refrigerant saturation temperature of the evaporator and the interior pressure of the intermediate-pressure chamber 12.

Figure 7:
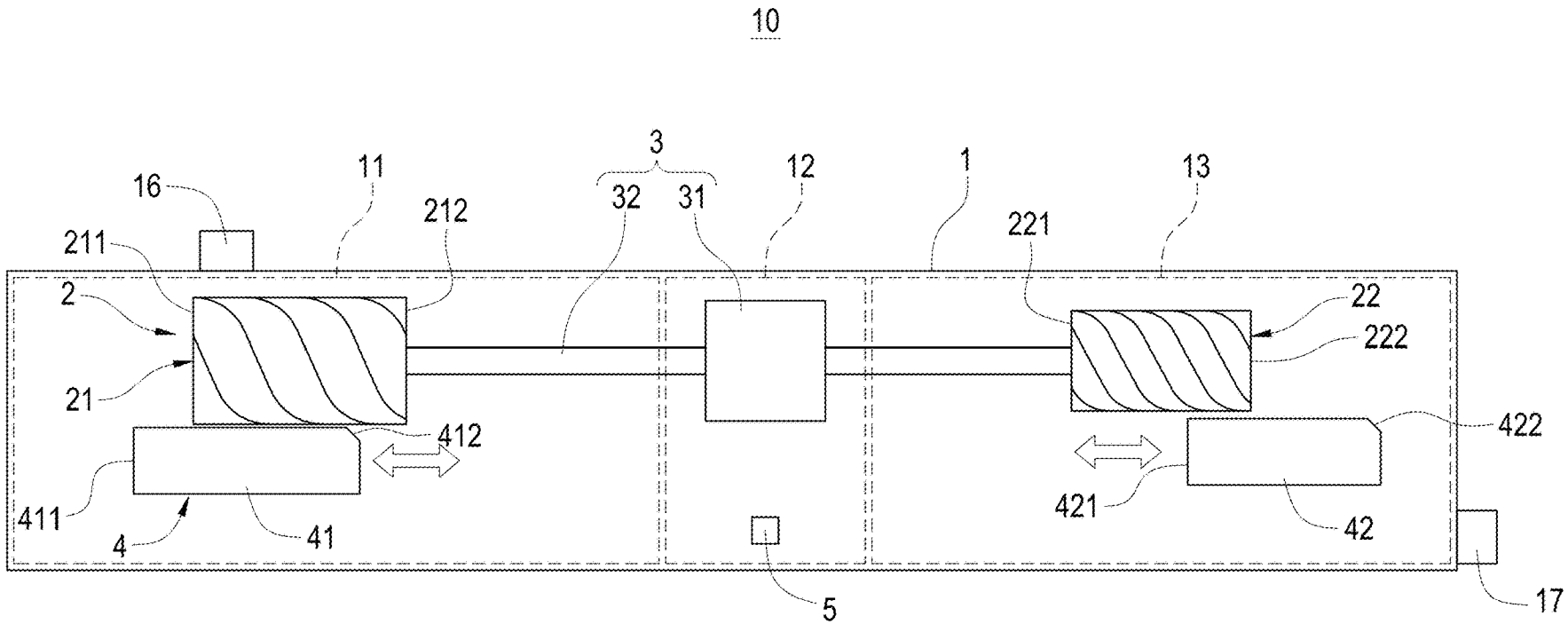
FIG. 7 is a schematic view of a third operating state of the fluid machine of the present disclosure.

Fourth, as shown in step D of FIG. 4 and in FIG. 7, when the first slide valve 41 moves to cover the first suction end 211, and a length of the second slide valve 42 between the second suction end 221 and the second discharge end 222 is equal to or less than 80% of a total length of the second slide valve 42, and the interior pressure of the intermediate-pressure chamber 12 is still not equal to the preset intermediate pressure, the controller 6 first controls the position of the first radial notch 412 to be at a designated position between the first suction end 211 and the first discharge end 212. Then, the controller 6 controls the second slide valve 42 to move towards the second suction end 221 (to increase the suction volume of the pair of second screws 22) or towards the second discharge end 222 (to decrease the suction volume of the pair of second screws 22), until the intermediate pressure sensor 5 detects that the interior pressure of the intermediate-pressure chamber 12 is equal to the preset intermediate pressure.

The designated position is determined by the controller 6 through calculations from the signals of the pressure at the intake port 16, the refrigerant saturation temperature at the evaporator, and the interior pressure of the intermediate-pressure chamber 12.

Moreover, step D is a special case and may not always occur. It may be omitted depending on the actual operating method of the fluid machine 10 of the present disclosure.

Figure 5:
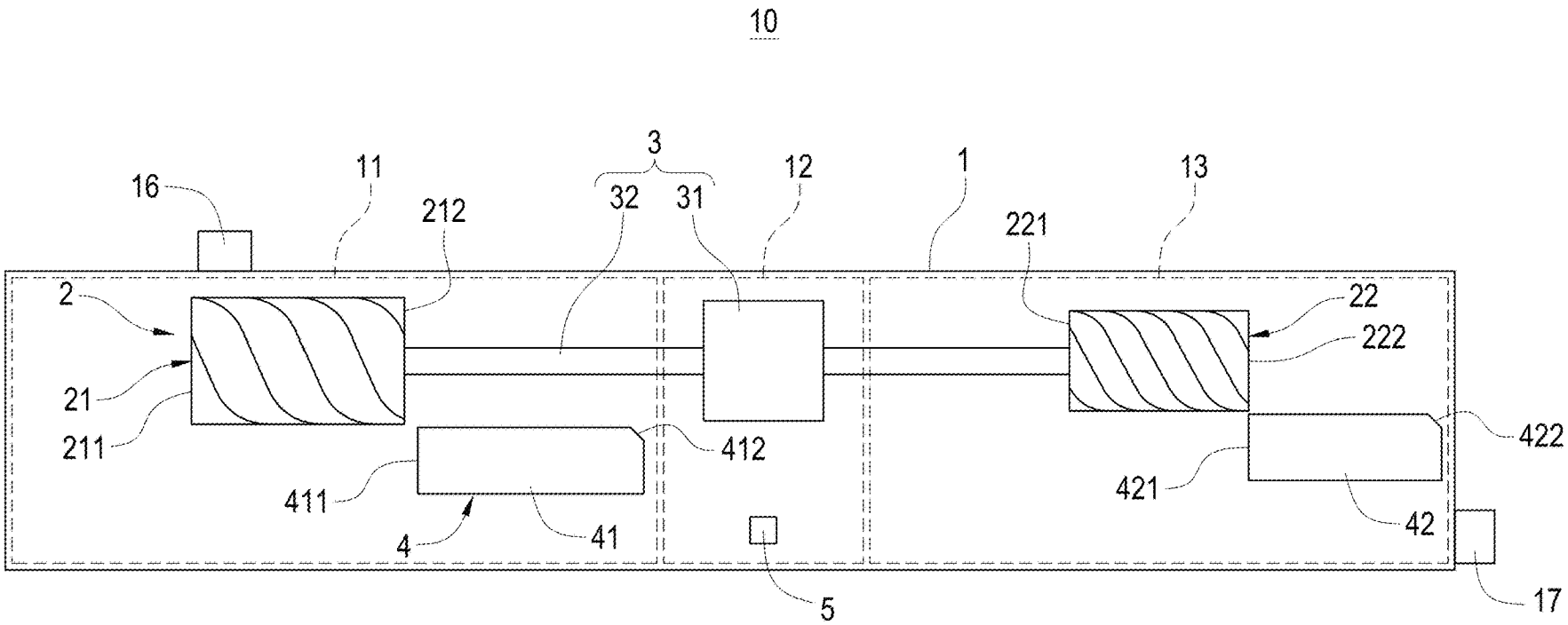
FIG. 5 is a schematic view of a first operating state of the fluid machine of the present disclosure.

As shown in step E of FIG. 4 and in FIG. 5, the controller 6 first moves the first slide valve 41 towards the first discharge end 212 and the second slide valve 42 towards the second suction end 221. Then, the drive module 3 is shut down. After the first screw 21 and the second screw 22 stop rotating, the lubricating fluid stops being injected into the intermediate-pressure chamber 12 and the high-pressure chamber 13. In this case, the first slide valve 41 is positioned between the intermediate-pressure chamber 12 and the first discharge end 212, and the second slide valve 42 is positioned between the exhaust port 17 and the second discharge end 222.

Thus, due to the stop positions of the first slide valve 41 and the second slide valve 42 being incorrect, when the drive module 3 is started again and drives the first screw 21 and the second screw 22 to rotate, it may cause excessive structural load on the screw set 2 and the drive module 3 or excessive exhaust pressure at the first discharge end 212, leading to damage to the fluid machine 10.

Figure 8:
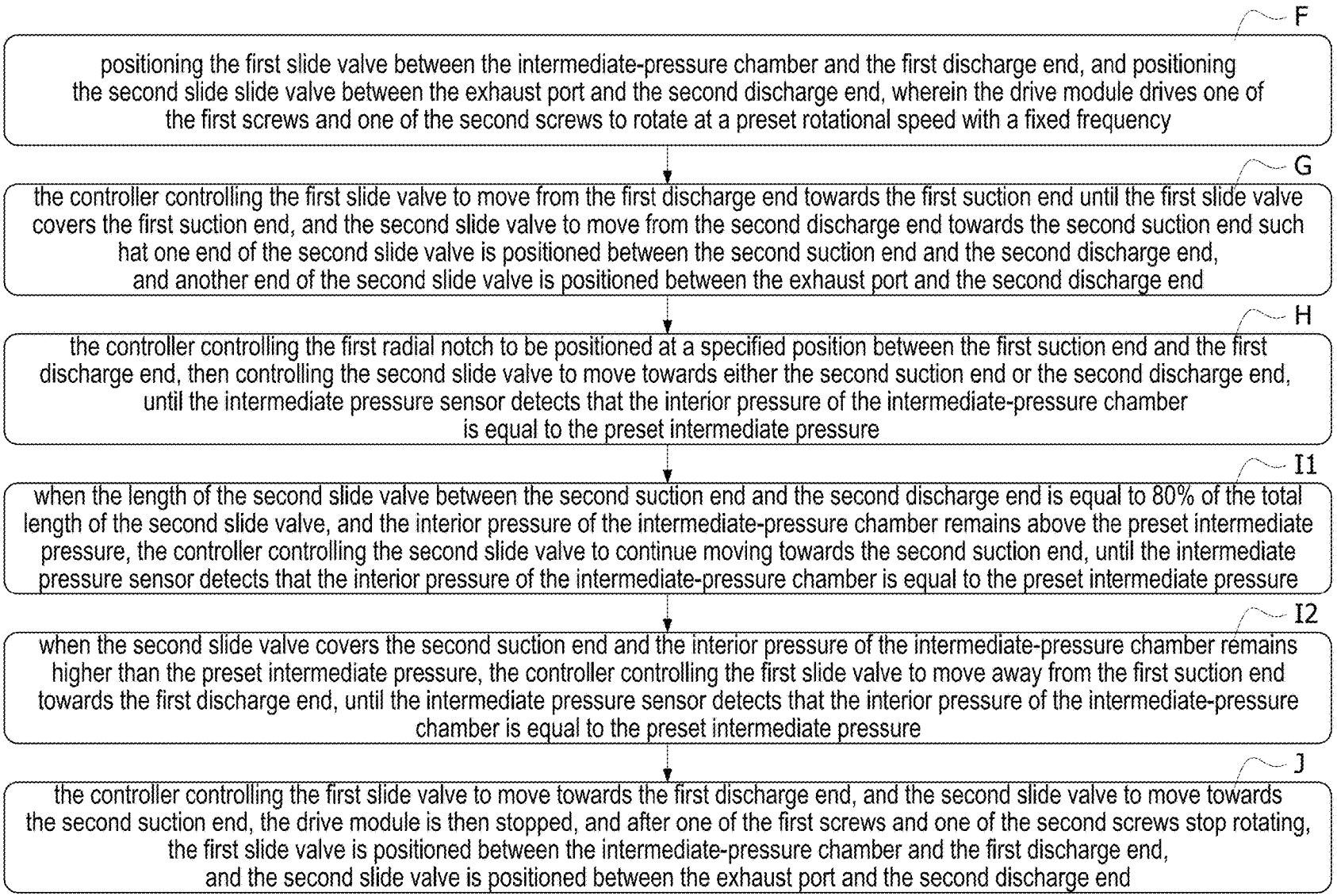
FIG. 8 is a flowchart of a second step in the operating method of the fluid machine of the present disclosure.

As shown in FIG. 8, this represents a second step in the operating method of the fluid machine 10 of the present disclosure, further explained as follows: First, as shown in step F of FIG. 8 and in FIG. 9, a fluid machine 10 as previously described is provided, with the first slide valve 41 positioned between the intermediate-pressure chamber 12 and the first discharge end 212, and the second slide valve 42 positioned between the exhaust port 17 and the second discharge end 222. The drive module 3 drives one of the first screws 21 and one of the second screws 22 to rotate at a constant preset rotational speed, which is set between 2950 to 3600 rpm, meaning a rotational frequency of the pair of first screws 21 and the pair of second screws 22 is fixed. When the first screw 21 and the second screw 22 begin to rotate, the lubricating fluid starts to be injected into the intermediate-pressure chamber 12 and the high-pressure chamber 13.

Figure 10:
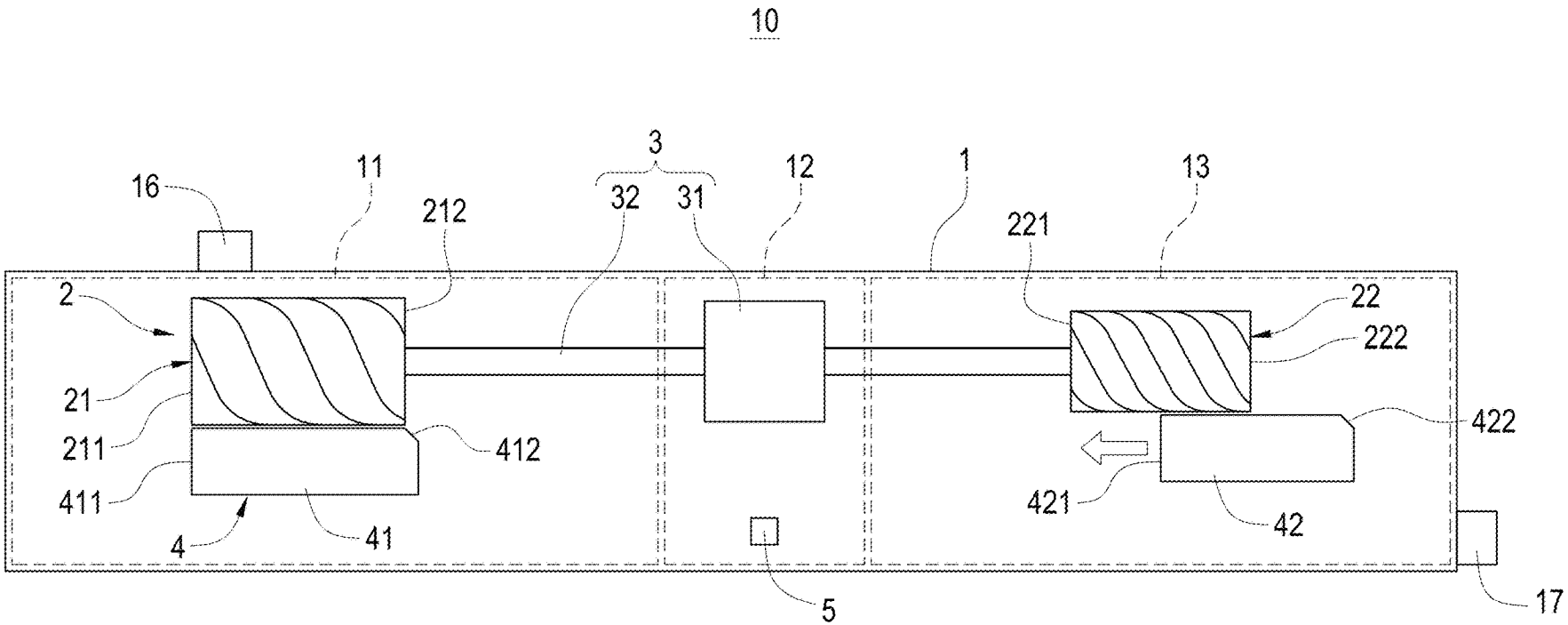
FIG. 10 is a schematic view of a fifth operating state of the fluid machine of the present disclosure.

Second, as shown in step G of FIG. 8 and in FIG. 10, the controller 6 controls the first slide valve 41 to move from the first discharge end 212 towards the first suction end 211 until the first slide valve 41 covers the first suction end 211, and the second slide valve 42 to move from the second discharge end 222 towards the second suction end 221 until one end of the second slide valve 42 is positioned between the second suction end 221 and the second discharge end 222, and the other end of the second slide valve 42 is between the exhaust port 17 and the second discharge end 222. The position of the first slide valve 41 is determined by the controller 6 through calculations using the signals of the refrigerant saturation temperature of the evaporator and the interior pressure of the intermediate-pressure chamber 12, while the position of the second slide valve 42 is determined by the controller 6 based on the interior pressure of the intermediate-pressure chamber 12 as measured by the intermediate pressure sensor 5 to be equal to the preset intermediate pressure.

Figure 11:
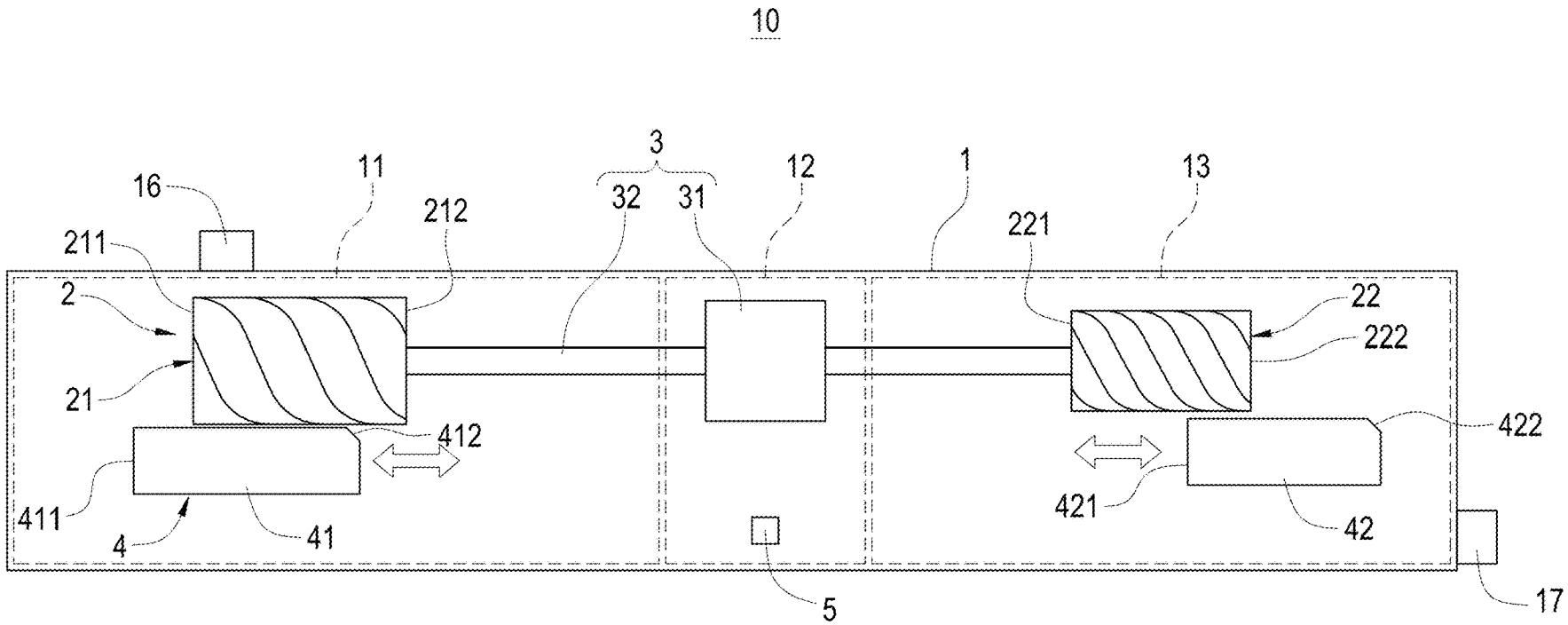
FIG. 11 is a schematic view of a sixth operating state of the fluid machine of the present disclosure.

Third, as shown in step H of FIG. 8 and in FIG. 11, the controller 6 first positions the first radial notch 412 at a designated position between the first suction end 211 and the first discharge end 212. Then, the controller 6 controls the second slide valve 42 to move towards the second suction end 221 (to increase the suction volume of the pair of second screws 22) or towards the second discharge end 222 (to decrease the suction volume of the pair of second screws 22), until the intermediate pressure sensor 5 detects that the interior pressure of the intermediate-pressure chamber 12 is equal to a preset intermediate pressure.

In step H, the length of the second slide valve 42 between the second suction end 221 and the second discharge end 222 is equal to or less than 80% of the total length of the second slide valve 42. This means that the second slide valve 42 covers 80% or less of the screw area of the pair of second screws 22, reserving at least 20% of the screw area for adjusting the interior pressure of the intermediate-pressure chamber 12. This is to prevent the interior pressure of the intermediate-pressure chamber 12 from continuing to rise and becoming unadjustable. The designated position is determined by the controller 6 through calculations using the signals of the pressure at the intake port 16, the refrigerant saturation temperature of the evaporator, and the interior pressure of the intermediate-pressure chamber 12.

Figure 12:
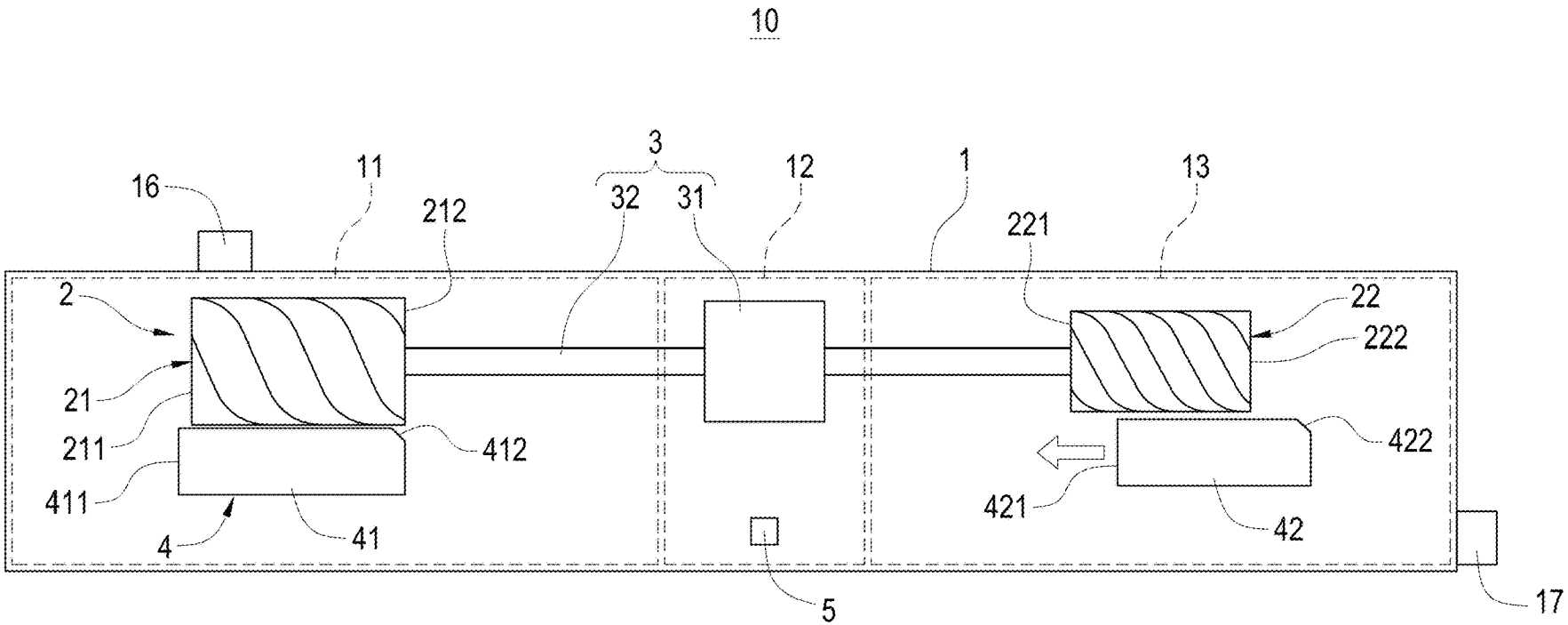
FIG. 12 is a schematic view of a seventh operating state of the fluid machine of the present disclosure.

Fourth, as shown in step I1 of FIG. 8 and in FIG. 12, when the second slide valve 42 is positioned such that its length between the second suction end 221 and the second discharge end 222 is equal to 80% of the total length of the second slide valve 42, and the intermediate pressure sensor 5 detects that the interior pressure of the intermediate-pressure chamber 12 is still above the preset intermediate pressure, at this point, the intermediate-pressure chamber 12 and the high-pressure chamber 13 are unable to successfully inject the lubricating fluid. The controller 6 then directs the second slide valve 42 to continue moving towards the second suction end 221, meaning the second slide valve 42 covers more than 80% of the screw area of the pair of second screws 22, thereby increasing the suction volume of the pair of second screws 22 until the intermediate pressure sensor 5 detects that the interior pressure of the intermediate-pressure chamber 12 is equal to the preset intermediate pressure, allowing the lubricating fluid to be successfully injected into the intermediate-pressure chamber 12 and the high-pressure chamber 13.

Additionally, when the intermediate pressure sensor 5 detects that the interior pressure of the intermediate-pressure chamber 12 is below the preset intermediate pressure, the controller 6 directs the second slide valve 42 to move from the second suction end 221 towards the second discharge end 222, thereby reducing the suction volume of the pair of second screws 22 until the intermediate pressure sensor 5 detects that the interior pressure of the intermediate-pressure chamber 12 is equal to the preset intermediate pressure.

Figure 13:
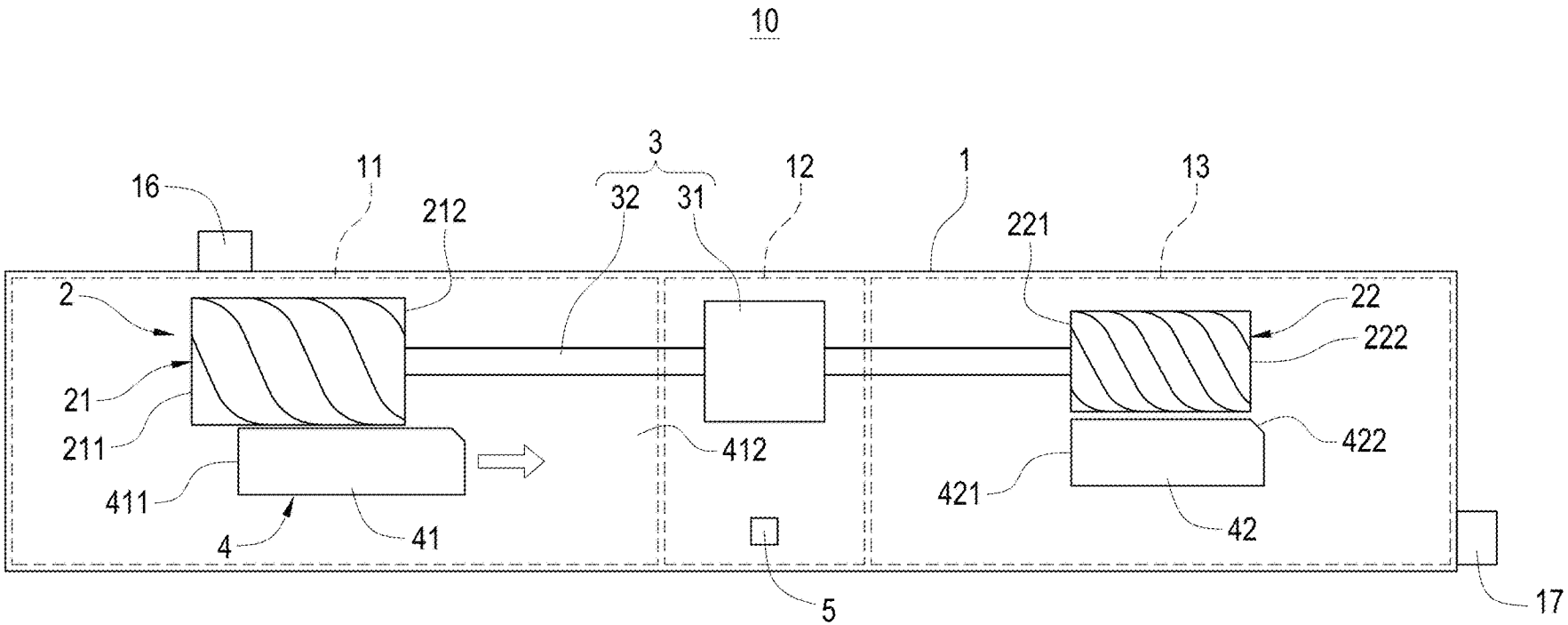
FIG. 13 is a schematic view of an eighth operating state of the fluid machine of the present disclosure.

Fifth, as shown in step I2 of FIG. 7 and in FIG. 13, when the second slide valve 42 covers the second suction end 221 and the interior pressure of the intermediate-pressure chamber 12 remains higher than the preset intermediate pressure, the controller 6 directs the first slide valve 41 to move away from the first suction end 211 towards the first discharge end 212. This action decreases the suction volume of the pair of first screws 21 until the intermediate pressure sensor 5 detects that the interior pressure of the intermediate-pressure chamber 12 is equal to the preset intermediate pressure.

Furthermore, steps I1 and I2 are special cases and may not always occur. Steps I1 and I2 may be omitted depending on the actual operating method of the fluid machine 10 of this disclosure.

Figure 9:
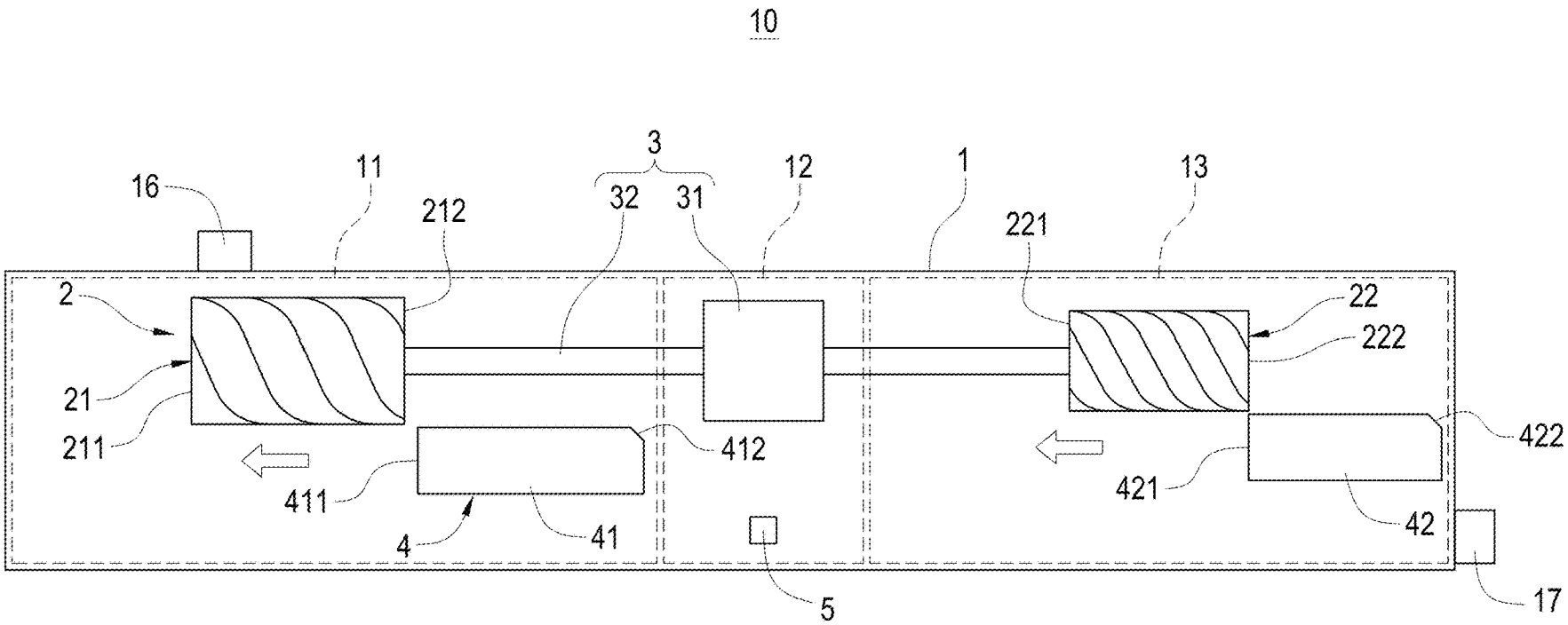
FIG. 9 is a schematic view of a fourth operating state of the fluid machine of the present disclosure.

Sixth, as shown in step J of FIG. 7 and in FIG. 9, the controller 6 controls the first slide valve 41 to move towards the first discharge end 212 and the second slide valve 42 to move towards the second suction end 221. Then, the drive module 3 is stopped. After the first screw 21 and the second screw 22 stop rotating, lubricating fluid stops being injected into the intermediate-pressure chamber 12 and the high-pressure chamber 13. At this point, the first slide valve 41 is positioned between the intermediate-pressure chamber 12 and the first discharge end 212, and the second slide valve 42 is positioned between the exhaust port 17 and the second discharge end 222.

As a result, due to the stop positions of the first slide valve 41 and the second slide valve 42 being incorrect, when the drive module 3 is started again and drives the first screw 21 and the second screw 22 to rotate, it may cause excessive structural load on the screw set 2 and the drive module 3 or excessive exhaust pressure at the first discharge end 212, leading to damage to the fluid machine 10.

Figure 14:
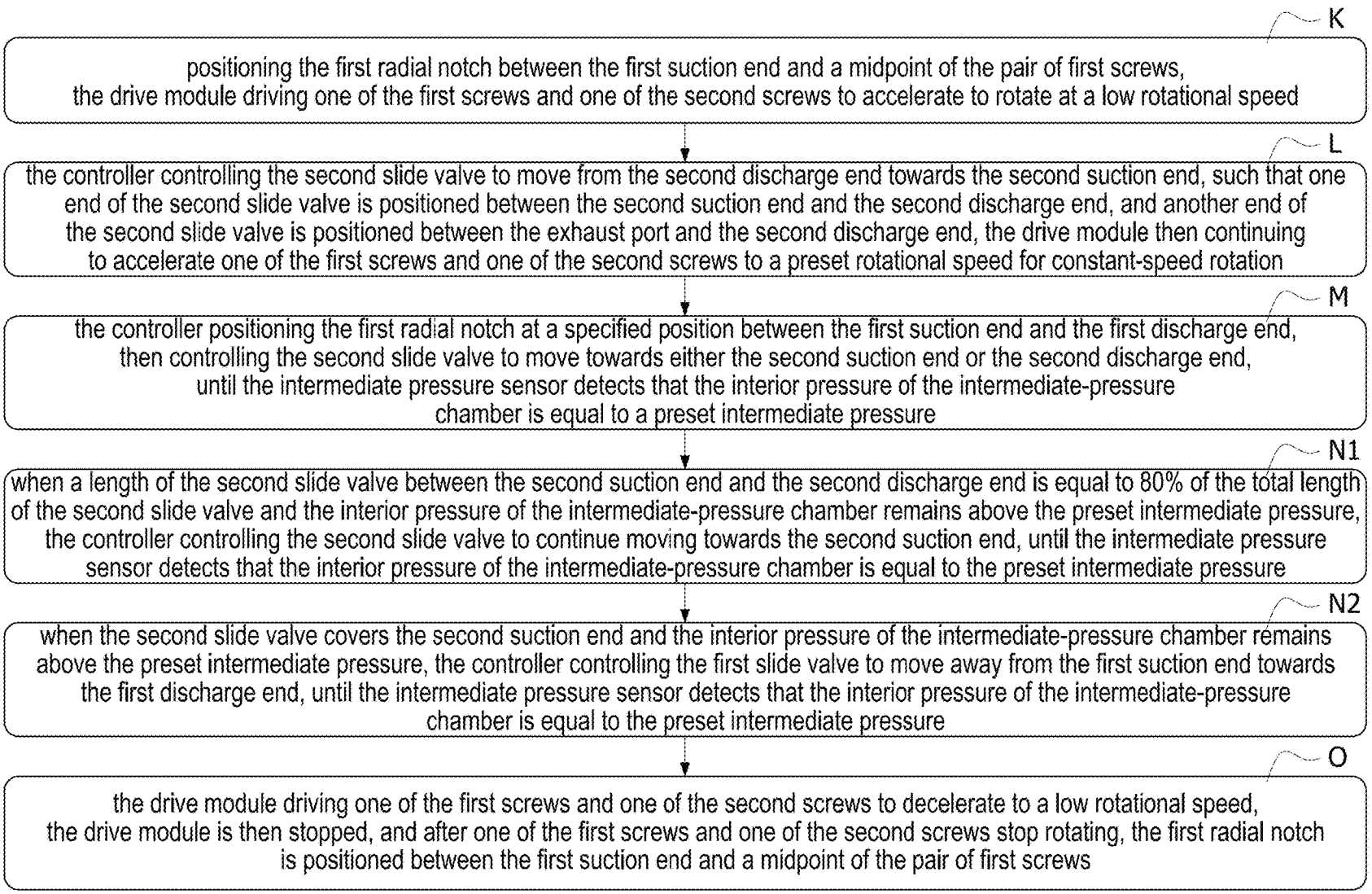
FIG. 14 is a flowchart of a third step in the operating method of the fluid machine of the present disclosure.

As shown in FIG. 14, it represents a third step in the operating method of the fluid machine 10 of the present disclosure, further explained as follows. First, as depicted in step K of FIG. 14 and in FIG. 15, a fluid machine 10 as previously described is provided, with the first radial notch 412 positioned between the first suction end 211 and the midpoint of the pair of first screws 21. The drive module 3 then drives one of the first screws 21 and one of the second screws 22 to accelerate to rotate at a low rotational speed. As the first screw 21 and the second screw 22 begin to rotate, the lubricating fluid starts to be injected into the intermediate-pressure chamber 12 and the high-pressure chamber 13.

Figure 16:
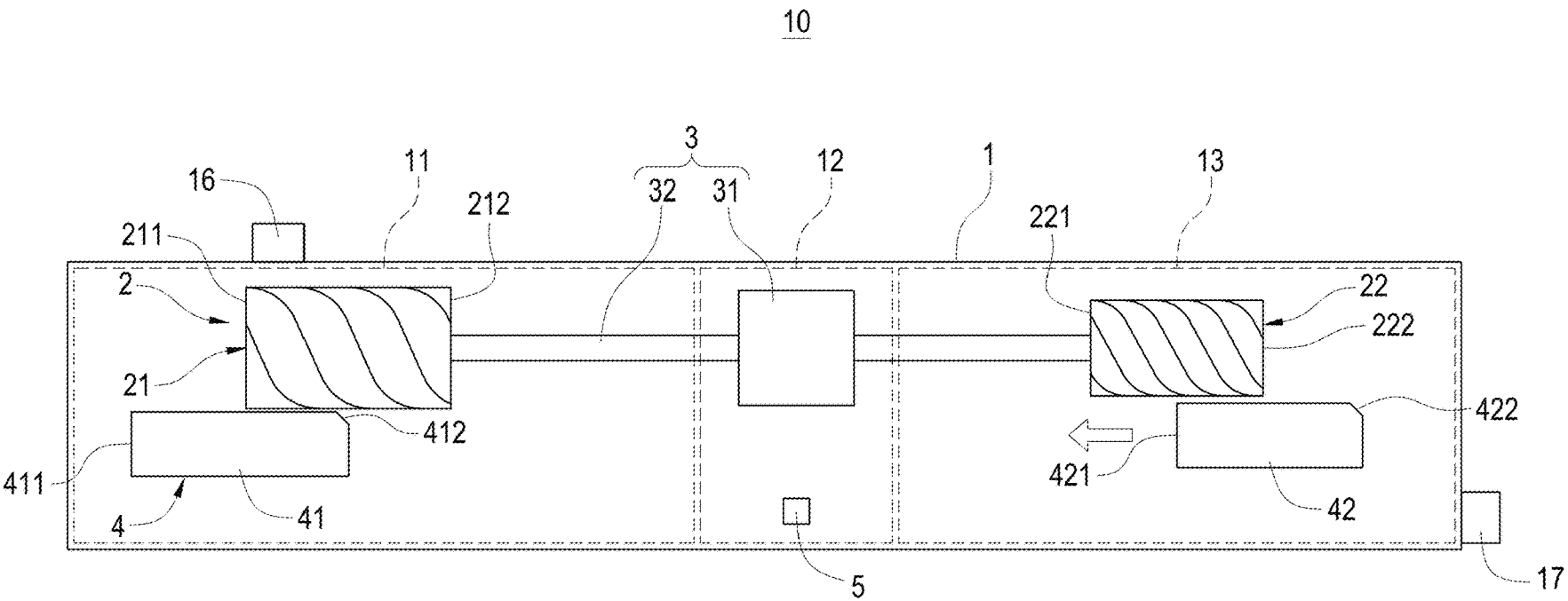
FIG. 16 is a schematic view of a tenth operating state of the fluid machine of the present disclosure.

Second, as shown in step L of FIG. 14 and in FIG. 16, the controller 6 controls the second slide valve 42 to move from the second discharge end 222 towards the second suction end 221 until one end of the second slide valve 42 is positioned between the second suction end 221 and the second discharge end 222, and the other end of the second slide valve 42 is positioned between the exhaust port 17 and the second discharge end 222. The drive module 3 then accelerates one of the first screws 21 and one of the second screws 22, continuing to increase their speed until reaching a preset rotational speed for constant-speed rotation.

The aforementioned low rotational speed refers to the rotational speed of the pair of first screws 21 and the pair of second screws 22 gradually increasing from zero to between one-third to one-half of the preset rotational speed. For example, if the preset rotational speed is between 1200 to 4200 rpm, then the low rotational speed is between 400 to 2100 rpm, although this disclosure is not limited in this regard.

Furthermore, as the rotational speed of one of the first screws 21 and one of the second screws 22 continues to increase to reach the preset rotational speed for constant-speed rotation, but the refrigerant saturation temperature of the evaporator approaches the refrigerant evaporation temperature, one of the first screws 21 and one of the second screws 22 maintain or slightly reduce their speed for constant-speed rotation based on the current speed.

Figure 17:
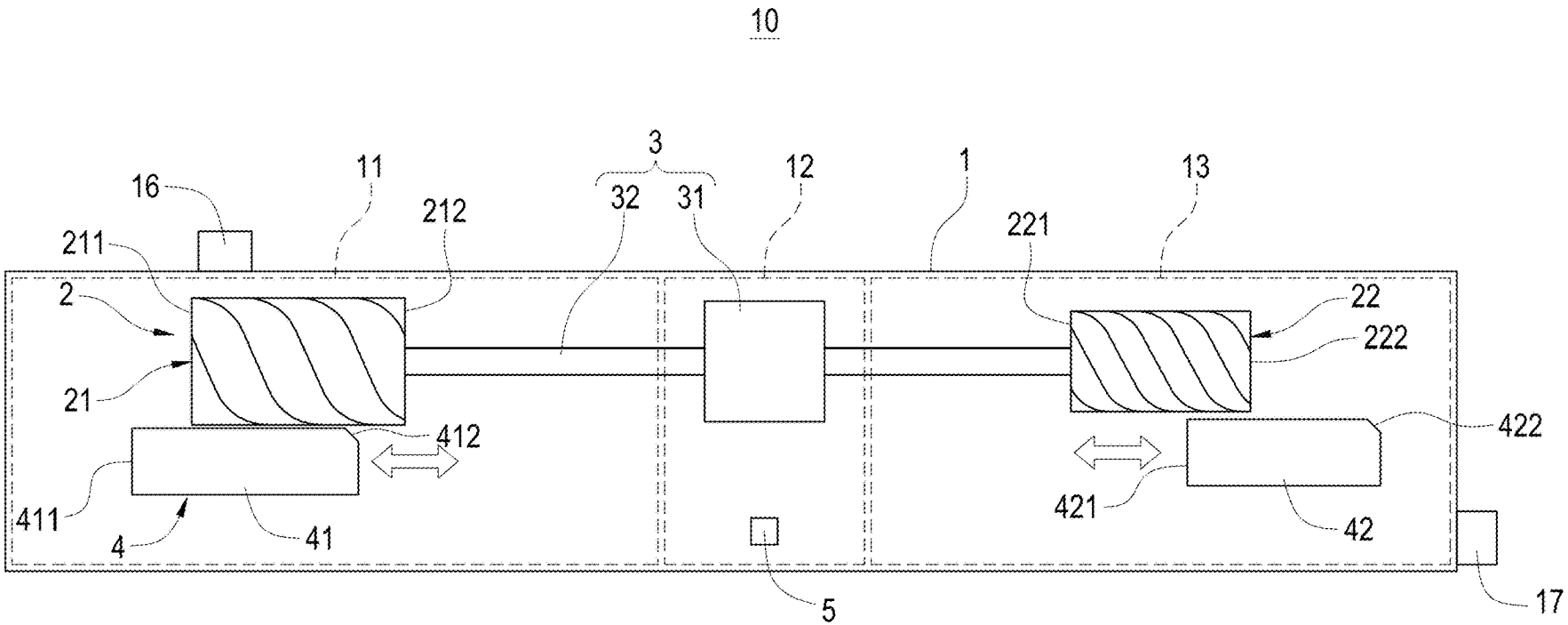
FIG. 17 is a schematic view of an eleventh operating state of the fluid machine of the present disclosure.

Third, as shown in step M of FIG. 14 and in FIG. 17, the controller 6 first controls the first radial notch 412 to be positioned at a designated position between the first suction end 211 and the first discharge end 212. Then, the controller 6 directs the second slide valve 42 to move towards the second suction end 221 (to increase the suction volume of the pair of second screws 22) or towards the second discharge end 222 (to decrease the suction volume of the pair of second screws 22), until the intermediate pressure sensor 5 detects that the interior pressure of the intermediate-pressure chamber 12 is equal to a preset intermediate pressure.

In step M, the length of the second slide valve 42 between the second suction end 221 and the second discharge end 222 is equal to or less than 80% of the total length of the second slide valve 42. This means the second slide valve 42 covers 80% or less of the screw area of the pair of second screws 22, leaving at least 20% of the screw area available for adjusting the interior pressure of the intermediate-pressure chamber 12. This arrangement prevents the subsequent inability to adjust the interior pressure of the intermediate-pressure chamber 12 as the interior pressure of the intermediate-pressure chamber 12 continues to rise. The designated position for this adjustment is calculated by the controller 6 using the signals of the pressure at the intake port 16, the refrigerant saturation temperature of the evaporator, and the interior pressure of the intermediate-pressure chamber 12.

Figure 18:
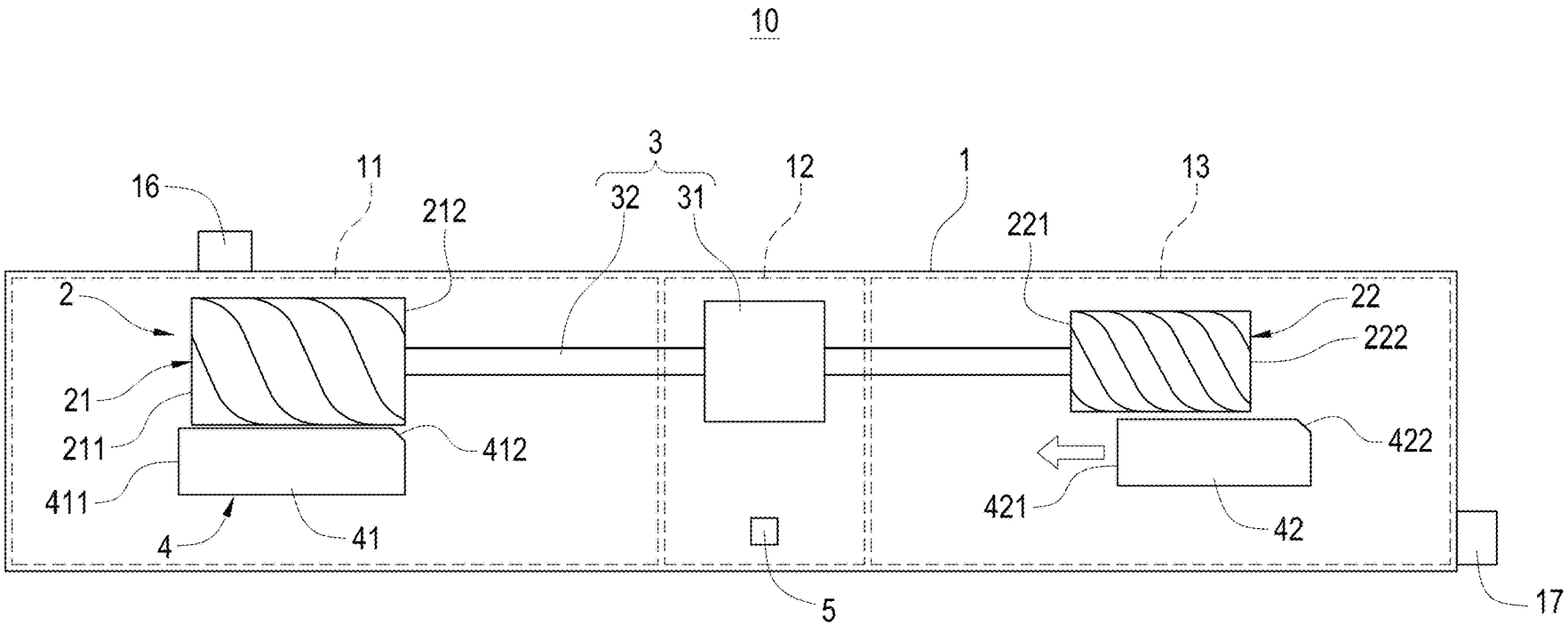
FIG. 18 is a schematic view of a twelfth operating state of the fluid machine of the present disclosure.

Fourth, as shown in step N1 of FIG. 14 and in FIG. 18, when the length of the second slide valve 42 between the second suction end 221 and the second discharge end 222 is equal to 80% of the total length of the second slide valve 42, and the intermediate pressure sensor 5 detects that the interior pressure of the intermediate-pressure chamber 12 is still higher than the preset intermediate pressure, at this point, the lubricating fluid is unable to be smoothly injected into the intermediate-pressure chamber 12. The controller 6 then controls the second slide valve 42 to continue moving towards the second suction end 221, meaning the second slide valve 42 covers more than 80% of the screw area of the pair of second screws 22, thereby increasing the suction volume of the pair of second screws 22 until the intermediate pressure sensor 5 detects that the interior pressure of the intermediate-pressure chamber 12 is equal to the preset intermediate pressure.

Furthermore, when the intermediate pressure sensor 5 detects that the interior pressure of the intermediate-pressure chamber 12 is below the preset intermediate pressure, the controller 6 controls the second slide valve 42 to move from the second suction end 221 towards the second discharge end 222, thereby decreasing the suction volume of the pair of second screws 22 until the interior pressure of the intermediate-pressure chamber 12 is equal to the preset intermediate pressure.

Figure 19:
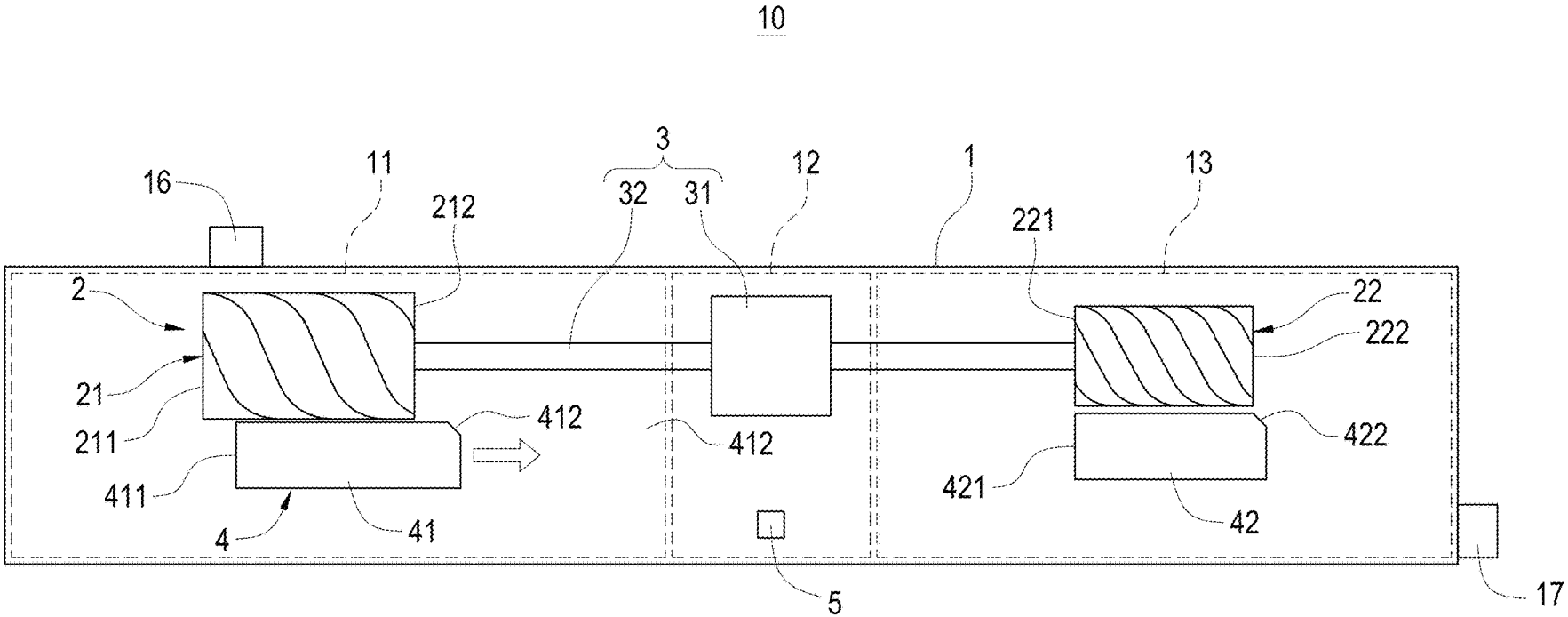
FIG. 19 is a schematic view of a thirteenth operating state of the fluid machine of the present disclosure.

Fifth, as shown in step N2 of FIG. 14 and in FIG. 19, when the second slide valve 42 covers the second suction end 221 and the interior pressure of the intermediate-pressure chamber 12 remains above the preset intermediate pressure, the controller 6 controls the first slide valve 41 to move away from the first suction end 211 towards the first discharge end 212, thereby decreasing the suction volume of the pair of first screws 21 until the intermediate pressure sensor 5 detects that the interior pressure of the intermediate-pressure chamber 12 is equal to the preset intermediate pressure.

Additionally, steps N1 and N2 are special cases and may not always occur. Steps N1 and N2 may be omitted depending on the actual operating method of the fluid machine 10 of this disclosure.

Figure 15:
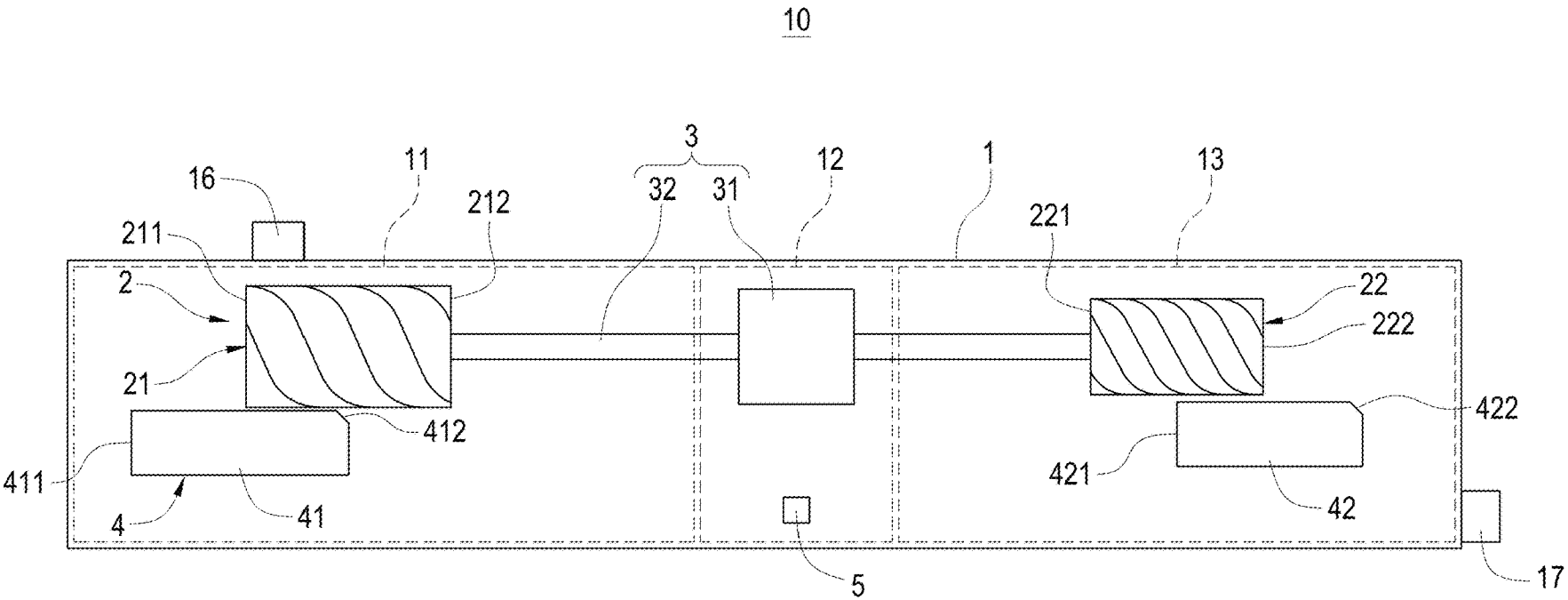
FIG. 15 is a schematic view of a ninth operating state of the fluid machine of the present disclosure.

Sixth, as shown in step O of FIG. 14 and in FIG. 15, the drive module 3 first reduces the speed of one of the first screws 21 and one of the second screws 22 to a low rotational speed. This means the rotational speed of the pair of first screws 21 and the pair of second screws 22 gradually decreases from the preset rotational speed to between one-third to one-half of the preset rotational speed, achieving a low rotational speed between 400-2100 rpm. However, these specifics are not limiting to the present disclosure.

The drive module 3 is then stopped, and after one of the first screws 21 and one of the second screws 22 stop rotating, the lubricating fluid ceases to be injected into the intermediate-pressure chamber 12 and the high-pressure chamber 13. The first radial notch 412 is positioned between the first suction end 211 and the midpoint of the pair of first screws 21.

Consequently, due to the incorrect stop position of the first radial notch 412, the next time the drive module 3 is started and drives one of the first screws 21 and one of the second screws 22 to rotate, it may cause excessive structural load on the screw set 2 and the drive module 3 or excessive exhaust pressure at the first discharge end 212, leading to damage to the fluid machine 10.

A related-art fluid machine has not taken into account the interior pressure of the intermediate-pressure chamber, leading to situations where, when the interior pressure of the intermediate-pressure chamber is too high, an economizer connected to both the intermediate-pressure chamber and the high-pressure chamber cannot inject the lubricating fluid. This results in abnormal oil supply to the second screws, thereby reducing efficiency.

In comparison, as illustrated from FIG. 1 to FIG. 19, the controller 6 of this disclosure adjusts the positions of the first slide valve 41 and the second slide valve 42 relative to the pair of first screws 21 and the pair of second screws 22, respectively, based on the rotational speeds of the first and second screws 21, 22 and the interior pressure values of the intermediate-pressure chamber 12. This adjustment regulates the interior pressure of the intermediate-pressure chamber 12 to maintain the interior pressure at a preset intermediate pressure, ensuring that the lubricating fluid is steadily injected into the intermediate-pressure chamber 12 and the high-pressure chamber 13. Once the lubricating fluid enters the intermediate-pressure chamber 12 and the high-pressure chamber 13, the lubricating fluid continues to lubricate the second screw 22 with the fluid flow, achieving good operational efficiency for the fluid machine 10 of this disclosure.

In summary, the fluid machine and the operating method presented in this disclosure have not been seen in similar products nor publicly used before. They possess industrial applicability, novelty, and an inventive step, fully meeting the requirements for a patent application. Therefore, an application is submitted in accordance with patent law to protect the rights of the inventor.

What is claimed is:

1. A fluid machine, comprising:

a main body (1), internally divided into a low-pressure chamber (11), an intermediate-pressure chamber (12), and a high-pressure chamber (13), sequentially interconnected to each other;

a screw set (2), comprising a pair of first screws (21) accommodated in the low-pressure chamber (11) and engaged with each other, and a pair of second screws (22) accommodated in the high-pressure chamber (13) and engaged with each other, wherein a first contact line (Z1) is defined between the pair of first screws (21), and a second contact line (Z2) is defined between the pair of second screws (22);

a drive module (3), disposed in the intermediate-pressure chamber (12), wherein the drive module (3) is connected and configured to drive one of the first screws (21) and one of the second screws (22) to rotate coaxially;

a capacity adjustment mechanism (4), comprising a first slide valve (41) movably disposed corresponding to the first contact line (Z1) and a second slide valve (42) movably disposed corresponding to the second contact line (Z2);

an intermediate pressure sensor (5), disposed in the intermediate-pressure chamber (12), wherein the intermediate pressure sensor (5) is configured to obtain an interior pressure of the intermediate-pressure chamber (12); and a controller (6), connected to and configured to drive the first slide valve (41) and the second slide valve (42) to move, wherein the controller (6) is configured to adjust relative position between the first slide valve (41) and the pair of first screws (21), and adjust relative position between the second slide valve (42) and the pair of second screws (22), based on a rotational speed of co-axial rotating of one of the first screws (21) and one of the second screws (22) and a value of the interior pressure;

wherein the low-pressure chamber (11) comprises an intake port (16), and the high-pressure chamber (13) comprises an exhaust port (17), each first screw (21) comprises a first suction end (211) and a first discharge end (212) at two ends, each second screw (22) comprises a second suction end (221) and a second discharge end (222) at two ends, the first slide valve (41) comprises a first low-pressure end (411) arranged on one end thereof corresponding to the first suction end (211) and a first radial notch (412) arranged on another end thereof corresponding to the first contact line (Z1), the second slide valve (42) comprises a second low-pressure end (421) arranged on one end thereof corresponding to the second suction end (221) and a second radial notch (422) arranged on another end thereof corresponding to the second contact line (Z2).

2. The fluid machine as claimed in claim 1, wherein when the pair of first screws (21) and the pair of second screws (22) rotate at a fixed rotational frequency, the controller (6) controls the second slide valve (42) to move from between the exhaust port (17) and the second discharge end (222) towards the second suction end (221), and the controller (6) moves the first slide valve (41) from between the intermediate-pressure chamber (12) and the first discharge end (212) towards the first suction end (211), until the interior pressure of the intermediate-pressure chamber (12) is equal to a preset intermediate pressure.

3. The fluid machine as claimed in claim 1, wherein when the pair of first screws (21) and the pair of second screws (22) rotate at a fixed rotational frequency, the first slide valve (41) covers the first suction end (211), one end of the second slide valve (42) is positioned between the second suction end (221) and the second discharge end (222), and another end of the second slide valve (42) is positioned between the exhaust port (17) and the second discharge end (222), the controller (6) controls the first radial notch (412) to be positioned at a designated position between the first suction end (211) and the first discharge end (212), then the controller (6) controls the second slide valve (42) to move towards the second suction end (221) or the second discharge end (222) until the intermediate pressure sensor (5) detects that the interior pressure of the intermediate-pressure chamber (12) is equal to a preset intermediate pressure.

4. The fluid machine as claimed in claim 1, wherein the first radial notch (412) is positioned between the first suction end (211) and a midpoint of the pair of first screws (21), and one end of the second slide valve (42) is positioned between the second suction end (221) and the second discharge end (222), and another end of the second slide valve (42) is positioned between the exhaust port (17) and the second discharge end (222), when the rotational speed of the pair of first screws (21) and the pair of second screws (22) is increased to a preset rotational speed for constant-speed rotation, the controller (6) controls the first radial notch (412) to be positioned at a designated position between the first suction end (211) and the first discharge end (212), then moves the second slide valve (42) towards the second suction end (221) or the second discharge end (222), until the intermediate pressure sensor (5) detects that the interior pressure of the intermediate-pressure chamber (12) is equal to a preset intermediate pressure.

5. An operating method of a fluid machine, the operating method comprising:

A) providing the fluid machine of claim 1, positioning the first slide valve (41) between the intermediate-pressure chamber (12) and the first discharge end (212), and positioning the second slide valve (42) between the exhaust port (17) and the second discharge end (222), wherein the drive module (3) drives one of the first screws (21) and one of the second screws (22) to rotate at a preset rotational speed with a fixed frequency;

B) the controller (6) controlling the second slide valve (42) to move from between the exhaust port (17) and the second discharge end (222) towards the second suction end (221); and C) the controller (6) controlling the first slide valve (41) to move from between the intermediate-pressure chamber (12) and the first discharge end (212) towards the first suction end (211), until the intermediate pressure sensor (5) detects that the interior pressure of the intermediate-pressure chamber (12) is equal to a preset intermediate pressure.

6. The operating method as claimed in claim 5, further comprising E) after the C), wherein the E) comprises the controller (6) controlling the first slide valve (41) to move towards the first discharge end (212) and the second slide valve (42) to move towards the second suction end (221), stopping the drive module (3), and after one of the first screws (21) and one of the second screws (22) stop rotating, positioning the first slide valve (41) between the intermediate-pressure chamber (12) and the first discharge end (212), and positioning the second slide valve (42) between the exhaust port (17) and the second discharge end (222).

7. The operating method as claimed in claim 6, further comprising D) between the C) and the E), wherein the D) comprises when the first slide valve (41) moves to cover the first suction end (211), and a length of the second slide valve (42) between the second suction end (221) and the second discharge end (222) is equal to or less than 80% of a total length of the second slide valve (42), and the interior pressure of the intermediate-pressure chamber (12) is not equal to the preset intermediate pressure, the controller (6) controlling the first radial notch (412) to be positioned at a designated position between the first suction end (211) and the first discharge end (212), the controller (6) then controlling the second slide valve (42) to move towards the second suction end (221) or the second discharge end (222), until the intermediate pressure sensor (5) detects that the interior pressure of the intermediate-pressure chamber (12) is equal to the preset intermediate pressure, wherein the designated position is calculated based on a pressure at the intake port (16) and the interior pressure of the intermediate-pressure chamber (12).

8. An operating method of a fluid machine, the operating method comprising:

F) providing the fluid machine of claim 1, positioning the first slide valve (41) between the intermediate-pressure chamber (12) and the first discharge end (212), and positioning the second slide valve (42) between the exhaust port (17) and the second discharge end (222), wherein the drive module (3) drives one of the first screws (21) and one of the second screws (22) to rotate at a preset rotational speed with a fixed frequency;

G) the controller (6) controlling the first slide valve (41) to move from the first discharge end (212) towards the first suction end (211) until the first slide valve (41) covers the first suction end (211), and the second slide valve (42) to move from the second discharge end (222) towards the second suction end (221) such that one end of the second slide valve (42) is positioned between the second suction end (221) and the second discharge end (222), and another end of the second slide valve (42) is positioned between the exhaust port (17) and the second discharge end (222); and H) the controller (6) controlling the first radial notch (412) to be positioned at a designated position between the first suction end (211) and the first discharge end (212), then controlling the second slide valve (42) to move towards either the second suction end (221) or the second discharge end (222), until the intermediate pressure sensor (5) detects that the interior pressure of the intermediate-pressure chamber (12) is equal to the preset intermediate pressure.

9. The operating method as claimed in claim 8, wherein the H) further comprises a length of the second slide valve (42) between the second suction end (221) and the second discharge end (222) is equal to or less than 80% of a total length of the second slide valve (42), and the designated position is determined through calculations from a pressure at the intake port (16) and the interior pressure of the intermediate-pressure chamber (12);

the operating method further comprises J) after the H), wherein the J) comprises the controller (6) controlling the first slide valve (41) to move towards the first discharge end (212) and the second slide valve (42) to move towards the second suction end (221), stopping the drive module (3), and after one of the first screws (21) and one of the second screws (22) stop rotating, positioning the first slide valve (41) between the intermediate-pressure chamber (12) and the first discharge end (212), and positioning the second slide valve (42) between the exhaust port (17) and the second discharge end (222).

10. The operating method as claimed in claim 9, further comprising I1) between the H) and the J), wherein the I1) comprises when the length of the second slide valve (42) between the second suction end (221) and the second discharge end (222) is equal to 80% of the total length of the second slide valve (42), and the interior pressure of the intermediate-pressure chamber (12) remains above the preset intermediate pressure, the controller (6) controlling the second slide valve (42) to continue moving towards the second suction end (221), until the intermediate pressure sensor (5) detects that the interior pressure of the intermediate-pressure chamber (12) is equal to the preset intermediate pressure.

11. The operating method as claimed in claim 10, further comprising I2) between the H) and the I1), wherein the I) comprises when the second slide valve (42) covers the second suction end (221) and the interior pressure of the intermediate-pressure chamber (12) remains higher than the preset intermediate pressure, the controller (6) controlling the first slide valve (41) to move away from the first suction end (211) towards the first discharge end (212), until the intermediate pressure sensor (5) detects that the interior pressure of the intermediate-pressure chamber (12) is equal to the preset intermediate pressure.

12. An operating method of a fluid machine, the operating method comprising:

K) providing the fluid machine of claim 1, positioning the first radial notch (412) between the first suction end (211) and a midpoint of the pair of first screws (21), the drive module (3) driving one of the first screws (21) and one of the second screws (22) to accelerate to rotate at a low rotational speed;

L) the controller (6) controlling the second slide valve (42) to move from the second discharge end (222) towards the second suction end (221), such that one end of the second slide valve (42) is positioned between the second suction end (221) and the second discharge end (222), and another end of the second slide valve (42) is positioned between the exhaust port (17) and the second discharge end (222), the drive module (3) then continuing to accelerate one of the first screws (21) and one of the second screws (22) to a preset rotational speed for constant-speed rotation; and M) the controller (6) positioning the first radial notch (412) at a designated position between the first suction end (211) and the first discharge end (212), then controlling the second slide valve (42) to move towards either the second suction end (221) or the second discharge end (222), until the intermediate pressure sensor (5) detects that the interior pressure of the intermediate-pressure chamber (12) is equal to a preset intermediate pressure.

13. The operating method as claimed in claim 12, wherein the M) further comprises a length of the second slide valve (42) between the second suction end (221) and the second discharge end (222) is equal to or less than 80% of a total length of the second slide valve (42), the designated position is determined through calculations from a pressure at the intake port (16) and the interior pressure of the intermediate-pressure chamber (12);

the operating method further comprises O) after the M), wherein the O) comprises the drive module (3) driving one of the first screws (21) and one of the second screws (22) to decelerate to a low rotational speed, stopping the drive module (3), and after one of the first screws (21) and one of the second screws (22) stop rotating, positioning the first radial notch (412) between the first suction end (211) and a midpoint of the pair of first screws (21).

14. The operating method as claimed in claim 13, further comprising N1) between the M) and the O), wherein the N1) comprises when a length of the second slide valve (42) between the second suction end (221) and the second discharge end (222) is equal to 80% of the total length of the second slide valve (42) and the interior pressure of the intermediate-pressure chamber (12) remains above the preset intermediate pressure, the controller (6) controlling the second slide valve (42) to continue moving towards the second suction end (221), until the intermediate pressure sensor (5) detects that the interior pressure of the intermediate-pressure chamber (12) is equal to the preset intermediate pressure.

15. The operating method as claimed in claim 14, further comprising N2) between the M) and the N1), wherein the N2) comprises when the second slide valve (42) covers the second suction end (221) and the interior pressure of the intermediate-pressure chamber (12) remains above the preset intermediate pressure, the controller (6) controlling the first slide valve (41) to move away from the first suction end (211) towards the first discharge end (212), until the intermediate pressure sensor (5) detects that the interior pressure of the intermediate-pressure chamber (12) is equal to the preset intermediate pressure.

* * * * *